US007114214B2

(12) United States Patent
Lavender

(10) Patent No.: US 7,114,214 B2
(45) Date of Patent: Oct. 3, 2006

(54) BASEBOARD BRUSH

(76) Inventor: Anthony A. Lavender, 201 Hunt St., Clermont, FL (US) 34711

( * ) Notice: Subject to any disclaimer, the term of this patent is extended or adjusted under 35 U.S.C. 154(b) by 117 days.

(21) Appl. No.: 10/903,766

(22) Filed: Aug. 2, 2004

(65) Prior Publication Data

US 2006/0021174 A1 Feb. 2, 2006

(51) Int. Cl.
*A47L 11/16* (2006.01)
*A46B 7/08* (2006.01)

(52) U.S. Cl. ..... 15/180; 15/49.1; 15/98; 15/230

(58) Field of Classification Search ..... 15/28, 15/29, 49.1, 50.1, 87, 98, 179, 180, 230
See application file for complete search history.

(56) References Cited

U.S. PATENT DOCUMENTS 1,554,622 A * 9/1925 Chancellor ..... 15/50.1
3,357,141 A 12/1967 Annis
3,533,120 A 10/1970 De Mercado
3,638,264 A * 2/1972 Walton ..... 15/4
3,715,772 A 2/1973 Downing et al.
4,391,548 A * 7/1983 Malish ..... 403/348
4,691,403 A 9/1987 Scharf
4,783,872 A 11/1988 Burhoe
5,261,139 A 11/1993 Lewis
5,371,912 A 12/1994 Hall
5,533,222 A * 7/1996 Lelkes et al. ..... 15/4

* cited by examiner

*Primary Examiner*—Mark Spisich
(74) *Attorney, Agent, or Firm*—Richard C. Litman

(57) ABSTRACT

A brush that simultaneously cleans and/or polishes floors and baseboards. The brush is adapted to be utilized with conventional buffing machines and will easily fit conventional water control rings. In its cleaning mode, the brush incorporates bristles on its planar undersurface and also entirely around its peripheral wall. When employed to polish, a polishing pad is positioned beneath the undersurface of the brush as is conventional in the art. A unique polishing pad is secured around the peripheral wall of the brush for contacting and polishing the baseboards.

8 Claims, 4 Drawing Sheets

BASEBOARD BRUSH

BACKGROUND OF THE INVENTION

1. Field of the Invention

The present invention generally relates to cleaning appliances. More specifically, the invention is drawn to a brush for a conventional floor-cleaning machine, which brush allows a user to clean or polish a floor and baseboard simultaneously.

2. Description of the Related Art

Separate procedures have been conventionally required to clean and/or polish floors and baseboards. Typically, a cleaning machine (buffer) is employed for the floor. The buffer utilizes a rotary driven brush and steel wool pads for efficient floor cleaning and polishing. Baseboards however, have been have been cleaned manually or with expensive and relatively complicated machines. Thus, cleaning both floors and baseboards has required a relatively large investment in man-hours or the acquisition of expensive machines. Both of these solutions are expensive. It is obvious that the art would welcome an inexpensive adjunct to the popular buffing machine, which adjunct would effectively clean and/or polish floors and baseboards simultaneously.

The related art is rife with alleged solutions to the above-discussed problem. For example, U.S. Pat. No. 3,533,120 (De Mercado), U.S. Pat. No. 5,261,139 (Lewis) and U.S. Pat. No. 5,371,912 (Hall) show machines for cleaning/polishing baseboards and floors simultaneously. All the machines employ plural rotary driven brushes that require complicated and expensive operating systems.

U.S. Pat. No. 3,715,772 (Downing et al.) discloses a buffing machine having an attachment that converts rotary motion to reciprocal motion. He attachment includes a rubbing surface that can clean baseboards. As in the above-cited patents, the instant attachment represents a relatively costly and complicated addition to the conventional buffer.

U.S. Pat. No. 3,357,141 (Annis, Jr.) and U.S. Pat. No. 4,783,872 (Barber) are drawn to machines for treating floors and baseboards. Both machines require specialized brushes that cannot be used with conventional buffers.

U.S. Pat. No. 4,691,403 (Scharf) shows a floor brush having bristles around the periphery thereof for cleaning baseboards. The bristles are not continuous and are therefore less efficient than the arrangement contemplated in the present invention. Also there is no provision to include a buffing pad on the periphery.

None of the above inventions and patents, taken either singly or in combination, is seen to disclose a brush for simultaneous cleaning or polishing floors and baseboards as will be subsequently described and claimed the instant invention.

SUMMARY OF THE INVENTION

The present invention is a brush that simultaneously cleans and/or polishes floors and baseboards. The brush is adapted to be utilized with conventional buffing machines and will easily fit conventional water control rings. In its cleaning mode, the brush incorporates bristles on its planar undersurface and also entirely around its peripheral wall. When employed to polish, a polishing pad is positioned beneath the undersurface of the brush as is conventional in the art. A unique polishing pad is secured around the peripheral wall of the brush for contacting and polishing the baseboards.

Accordingly, the invention presents a novel brush for effective, efficient and simultaneous cleaning of floors and baseboards. The brush is designed for use with conventional floor machines. A unique pad permits the brush to also function to polish floors and baseboards simultaneously.

The present invention provides for improved elements and arrangements thereof for the purposes described which are inexpensive, dependable and fully effective in accomplishing their intended purposes.

A clear understanding of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
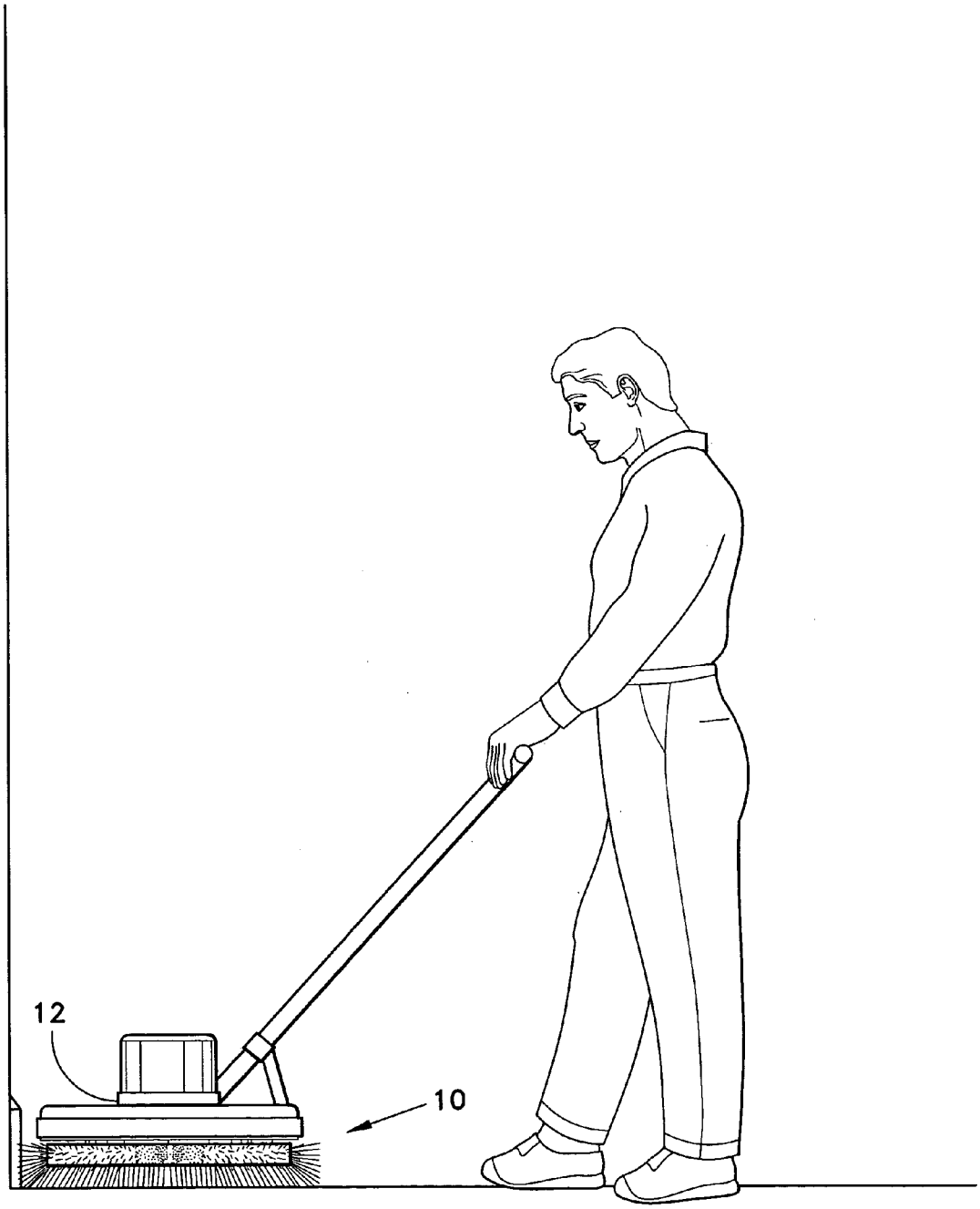
FIG. 1 is an environmental, perspective view of a baseboard and floor brush according to the present invention.
Figure 2:
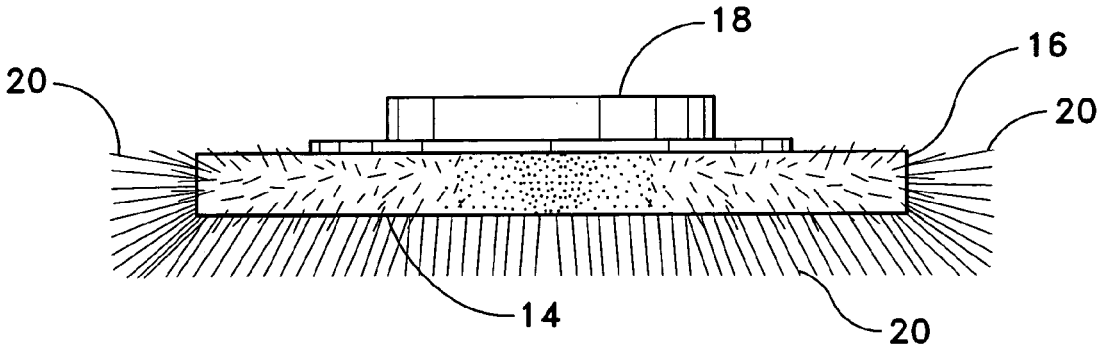
FIG. 2 is a plan view of first embodiment of a baseboard and floor brush according to the present invention.
Figure 3:
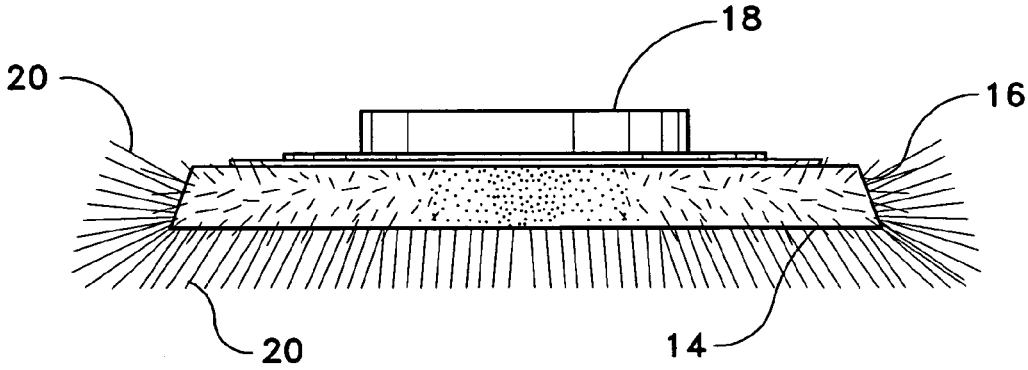
FIG. 3 is a plan view of second embodiment of a baseboard and floor brush according to the present invention.

Attention is first directed to FIGS. 1–3 wherein the baseboard and floor brush of the present invention is indicated at 10. Brush 10 is mounted on the mounting ring 12 of a conventional, rotary floor-cleaning machine. Brush 10 is of disc-shaped configuration as is well known in the art. As best seen in FIGS. 2 and 3, brush 10 comprises a planar undersurface 14, peripheral wall 16 and mounting flange 18. Undersurface 14 and peripheral wall 16 are provided with an array of bristles 20 suitably attached thereto. The bristles are evenly and continuously disposed over the entire surface areas of surface 14 and wall 16. In FIG. 2 wall 16 is perpendicular to surface 14 for cleaning traditionally configured baseboard. In FIG. 3, wall 16 is slanted inward which allow the bristles to clean baseboards having overhanging or convoluted surfaces.

Figure 4:
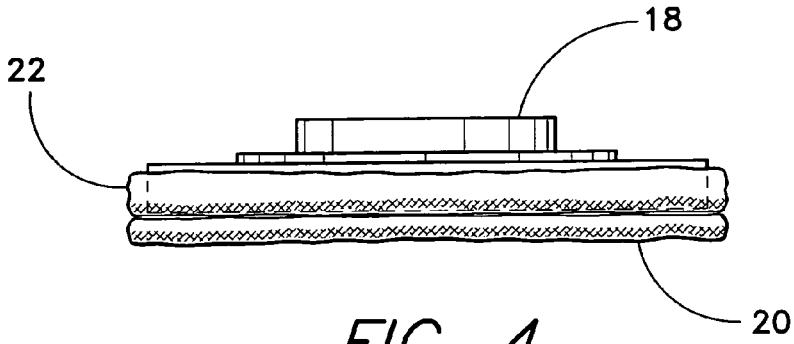
FIG. 4 is a plan view of a baseboard and floor brush in a polishing mode according to the present invention.
Figure 5:
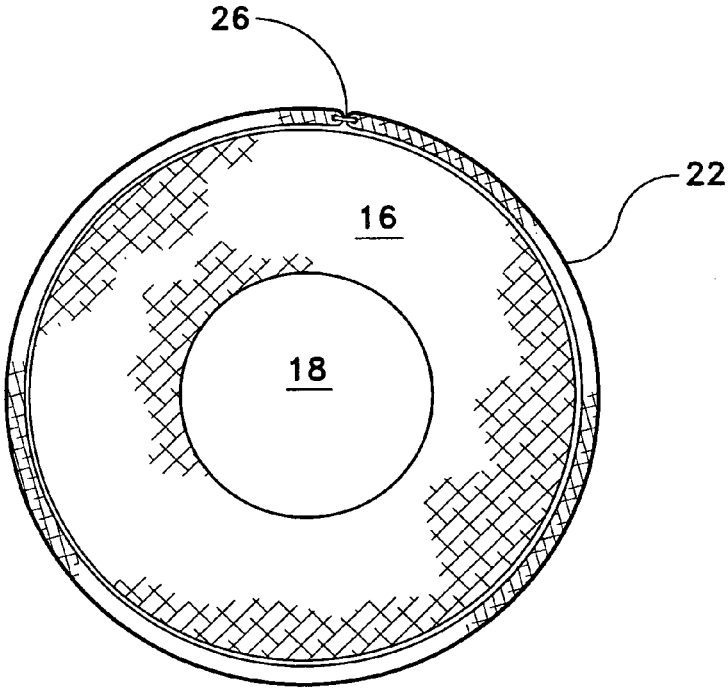
FIG. 5 is a top view of a baseboard and floor brush in a polishing mode according to the present invention.
Figure 6:
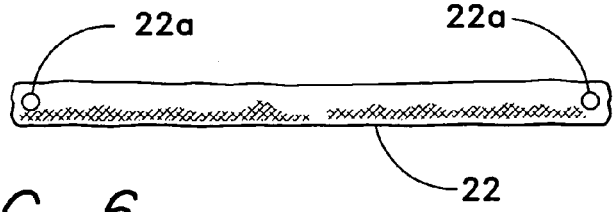
FIG. 6 is a plan view of a baseboard-polishing pad for a baseboard and floor brush according to the present invention.

FIGS. 4–6 are illustrative of the brush when used for polishing. A conventional circular polishing pad 20 is positioned beneath the brush in the usual manner. A baseboard polishing pad 22 is disposed around and encompasses peripheral wall 16. Openings 22*a* are provided at each end of pad 22 for receiving a fastener 26 and securing pad 22 on wall 16.

Figure 7:
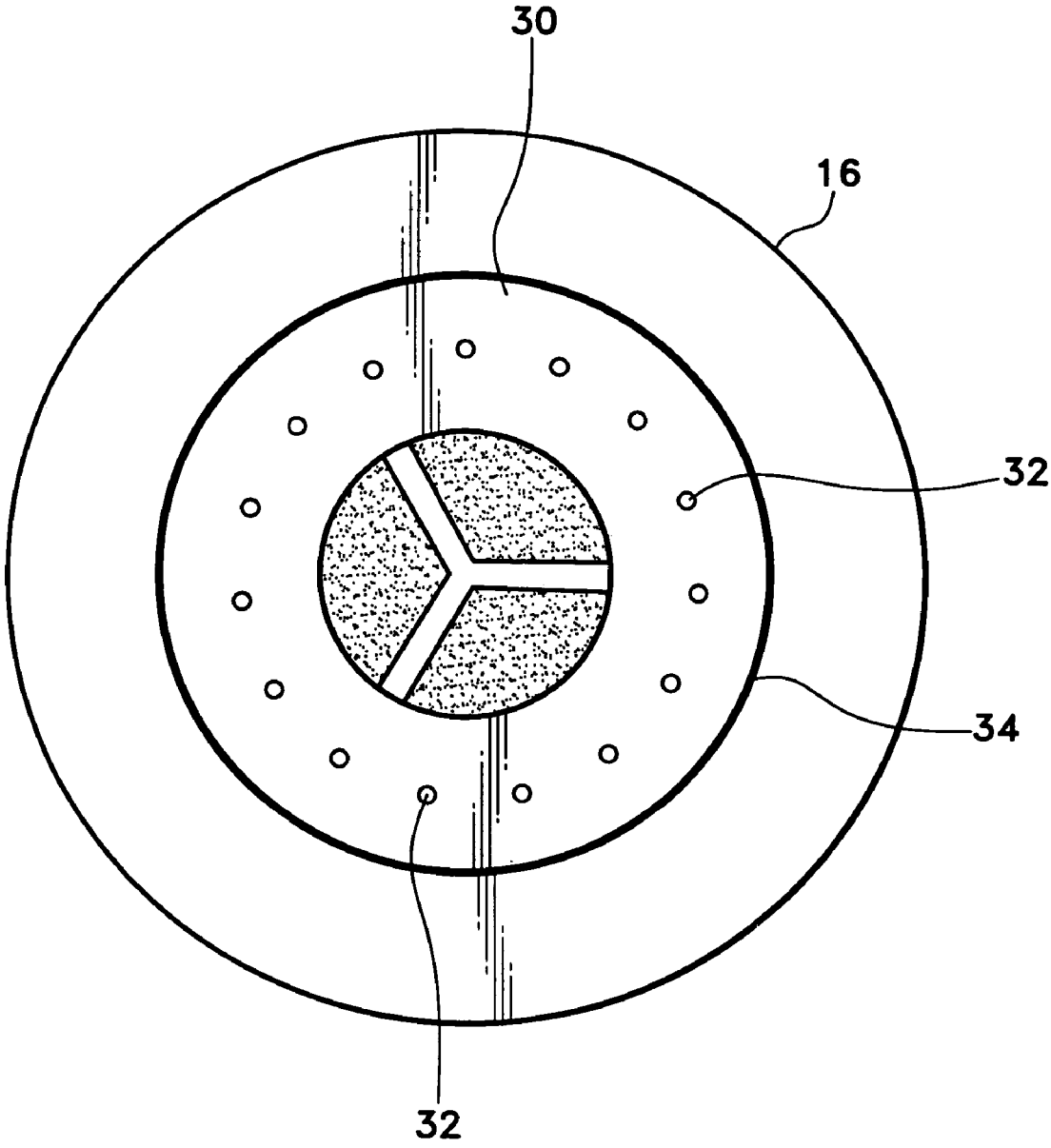
FIG. 7 is a plan view of a baseboard-polishing pad for a baseboard and floor brush having a water control ring according to the present invention.

FIG. 7 is illustrative of the brush when used in conjunction with a conventional liquid feeder 30. Feeder 30 is positioned atop the brush and is designed with conventional liquid dispensing holes 32 and liquid control ring 34.

It is to be understood that the present invention is not limited to the embodiments described above, but encompasses any and all embodiments within the scope of the following claims.

I claim:

1. A baseboard and floor cleaning brush, comprising:

a circular disc-shaped member having a planar undersurface and a top surface, said planar under surface defining an undersurface area;

a peripheral wall connecting said top surface with said planar undersurface, said peripheral wall defining a peripheral area;

a first array of bristles disposed on said undersurface and attached directly thereto;

a second array of bristles disposed on said peripheral wall and attached directly thereto, said second array of bristles encompassing the entire peripheral area defined by the peripheral wall;

a polishing pad disposed on said peripheral wall, wherein said polishing pad comprises;

a narrow strip having a first end and a second end;

a respective opening disposed through each of said first end and said second end.

2. The baseboard and floor cleaning brush according to claim 1, further including a mounting flange positioned on said top surface.

3. The baseboard and floor cleaning brush according to claim 1, wherein said narrow strip encompasses said peripheral wall and including a fastener disposed through each said respective opening for securing said narrow strip to said peripheral wall.

4. The baseboard and floor cleaning brush according to claim 1, wherein said polishing pad is fabricated from steel wool.

5. The baseboard and floor cleaning brush according to claim 1, wherein said peripheral wall is perpendicular to said planar undersurface.

6. The baseboard and floor cleaning brush according to claim 1, wherein said peripheral wall is disposed at an acute angle to said planar undersurface.

7. A floor cleaning machine having a mounting ring and a baseboard and floor cleaning brush mounted to said mounting ring, said baseboard and floor cleaning brush comprising:

a circular disc-shaped member having a planar undersurface and a top surface, said planar under surface defining an undersurface area;

a peripheral wall connecting said top surface with said planar undersurface, said peripheral wall defining a peripheral area;

a first array of bristles disposed on said undersurface and attached directly thereto;

a second array of bristles disposed on said peripheral wall and attached directly thereto, said second array of bristles encompassing the entire peripheral area defined by the peripheral wall;

a mounting flange positioned on said top surface and mounted to said mounting ring; and a polishing pad, said polishing pad being disposed on said peripheral wall wherein said polishing pad comprises;

a narrow strip having a first end and a second end;

a respective opening disposed through each of said first end and said second end.

8. A floor cleaning machine according to claim 7, wherein said narrow strip encompasses said peripheral wall and including a fastener disposed through each said respective opening for securing said narrow strip to said peripheral wall.

* * * * *